US007367454B1

(12) United States Patent
Back et al.

(10) Patent No.: US 7,367,454 B1
(45) Date of Patent: May 6, 2008

(54) INSERT FOR RETAINING VIALS IN A CASE

(76) Inventors: Alan W. Back, 12999 Rome Rd., Manitou Beach, MI (US) 49253; Misty S. Cooper, 12999 Rome Rd., Manitou Beach, MI (US) 49253

( * ) Notice: Subject to any disclaimer, the term of this patent is extended or adjusted under 35 U.S.C. 154(b) by 44 days.

(21) Appl. No.: 10/448,688

(22) Filed: May 30, 2003

(51) Int. Cl.
*B65D 85/20* (2006.01)

(52) U.S. Cl. ..... 206/446; 206/562

(58) Field of Classification Search ..... 206/443, 206/446, 561–562, 564, 472, 363–366, 372–373, 206/378–380, 385; 53/452, 453
See application file for complete search history.

(56) References Cited

U.S. PATENT DOCUMENTS

| | | | | | |
|---|---|---|---|---|---|
| 491,136 | A | | 2/1893 | Rosenblatt | |
| 505,222 | A | | 9/1893 | Hoff | |
| 1,121,232 | A | | 12/1914 | Davis | |
| 1,727,235 | A | | 9/1929 | Joyse, Jr. | |
| 1,780,268 | A | * | 11/1930 | Miller | 206/433 |
| 3,363,823 | A | | 1/1968 | Paige et al. | |
| 3,557,489 | A | * | 1/1971 | Ferrand | 47/87 |
| 4,415,086 | A | * | 11/1983 | Bennett, Jr. | 206/564 |
| 4,478,337 | A | * | 10/1984 | Flum | 211/59.2 |
| 4,572,371 | A | * | 2/1986 | Asenbauer | 206/443 |
| 4,645,079 | A | * | 2/1987 | Hill | 206/563 |
| D320,738 | S | * | 10/1991 | Kanda et al. | D9/737 |
| D332,187 | S | * | 1/1993 | Stravitz | D6/407 |
| 5,361,907 | A | | 11/1994 | Mohrhauser | |
| 5,392,557 | A | * | 2/1995 | Harmon et al. | 43/57.1 |
| 5,394,986 | A | * | 3/1995 | Oya et al. | 206/445 |
| 5,441,152 | A | * | 8/1995 | Estes | 206/570 |
| 5,500,631 | A | * | 3/1996 | Negus | 335/285 |
| D392,463 | S | * | 3/1998 | Grey | D3/319 |
| 5,810,163 | A | | 9/1998 | Nakabayashi | |
| 6,019,225 | A | | 2/2000 | Kalmakis et al. | |
| 6,536,156 | B1 | * | 3/2003 | Peterson | 43/54.1 |

* cited by examiner

*Primary Examiner*—Shian T. Luong
(74) *Attorney, Agent, or Firm*—Young Basile Hanlon MacFarlane & Helmholdt, PC

(57) ABSTRACT

An apparatus for receiving a plurality of elongate vials, and a process for manufacturing the apparatus is disclosed. Each vial has a longitudinal length and an outer maximum diameter. The apparatus includes a single piece insert having a base wall with a plurality of integrally formed, parallel, elongate ridges extending outwardly therefrom in transversely spaced relationship with respect to one another to define a vial-receiving slot between each pair of adjacent ridges. The elongate ridges are spaced transversely from one another by a distance slightly less than the outer maximum diameter of each vial to be received therein permitting an interference press fit therebetween. The elongate ridges extend along a substantial portion of the longitudinal length of each vial to be received therein. A stop rib can be provided extending transversely adjacent one end of the plurality of ridges. At least one of the insert can be associated with a case. The case can have a back wall, at least one peripheral side wall, and a cover.

31 Claims, 7 Drawing Sheets

INSERT FOR RETAINING VIALS IN A CASE

FIELD OF THE INVENTION

The present invention relates to an apparatus for holding a plurality of vials, ampules, or other elongate receptacles with respect to one another, and more particularly, to an apparatus for holding a plurality of vials, ampules, or elongate receptacles with respect to one another in a sturdy enclosure or case.

BACKGROUND OF THE INVENTION

Various types of cases have been proposed for storing vials, ampules, or other containers or receptacles of material. For example, see U.S. Pat. No. 491,136; U.S. Pat. No. 505,222; U.S. Pat. No. 1,121,232; U.S. Pat. No. 1,727,235; U.S. Pat. No. 3,363,823; U.S. Pat. No. 5,361,907; U.S. Pat. No. 5,810,163; and U.S. Pat. No. 6,019,225. Each of these devices are relatively complicated in structure and manufacturing requirements. Many of the known devices while suitable for shipping purposes or other temporary packaging, do not provide sufficient protection, or are not made of durable materials sufficient to provide long term safe storage of the enclosed receptacles for extended periods of time. It has been found that cases made with cardboard or other paper based materials, are subject to damage from water, humidity, and other environmental changes which degrade the paper based materials over time.

SUMMARY OF THE INVENTION

It would be desirable in the present invention to provide an apparatus for retaining vials, ampules, or other receptacles or containers in a case that could be produced economically while providing long term storage of the enclosed containers while resisting environmental exposure over extended time periods. The present invention relates to an insert for receiving vials, ampules, containers, or the like, where two substantially parallel, hollow walls or ridges are separated with respect to one another by a distance slightly less than the outer diameter of the vial, ampule, container, or the like to be received permitting a press-fit connection of the vial, ampule, receptacle, or the like therebetween. Preferably, the insert includes a plurality of parallel walls or ridges spaced from one another for receiving a plurality of vials, ampules, receptacles, containers, or the like. In the preferred configuration, the present invention can include a plastic insert for retaining vials in a storage case. The insert can be sized to fit within a case, such as a standard VHS cassette or other case of suitable dimensions. The case can be made of plastic with living hinges to create a folding cover that can be snapped in place. The insert according to the present invention can be positioned on at least one surface of the interior of the case, or can be positioned on both the cover surface and the bottom surface of the case to increase the storing capacity. The insert according to the present invention can be sold separately, or can be pre-assembled into the cases prior to sale. The insert according to the present invention is particularly well suited to store vials typically used in the medical community for a variety of purposes. The present invention increases the storage capacity of the vial container case, and uses a case that is more durable than those currently being used on the market. The plastic insert and plastic case is more durable than cardboard box configurations currently being used for vial storage in the medical community.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION OF THE PREFERRED EMBODIMENT

Figure 1:
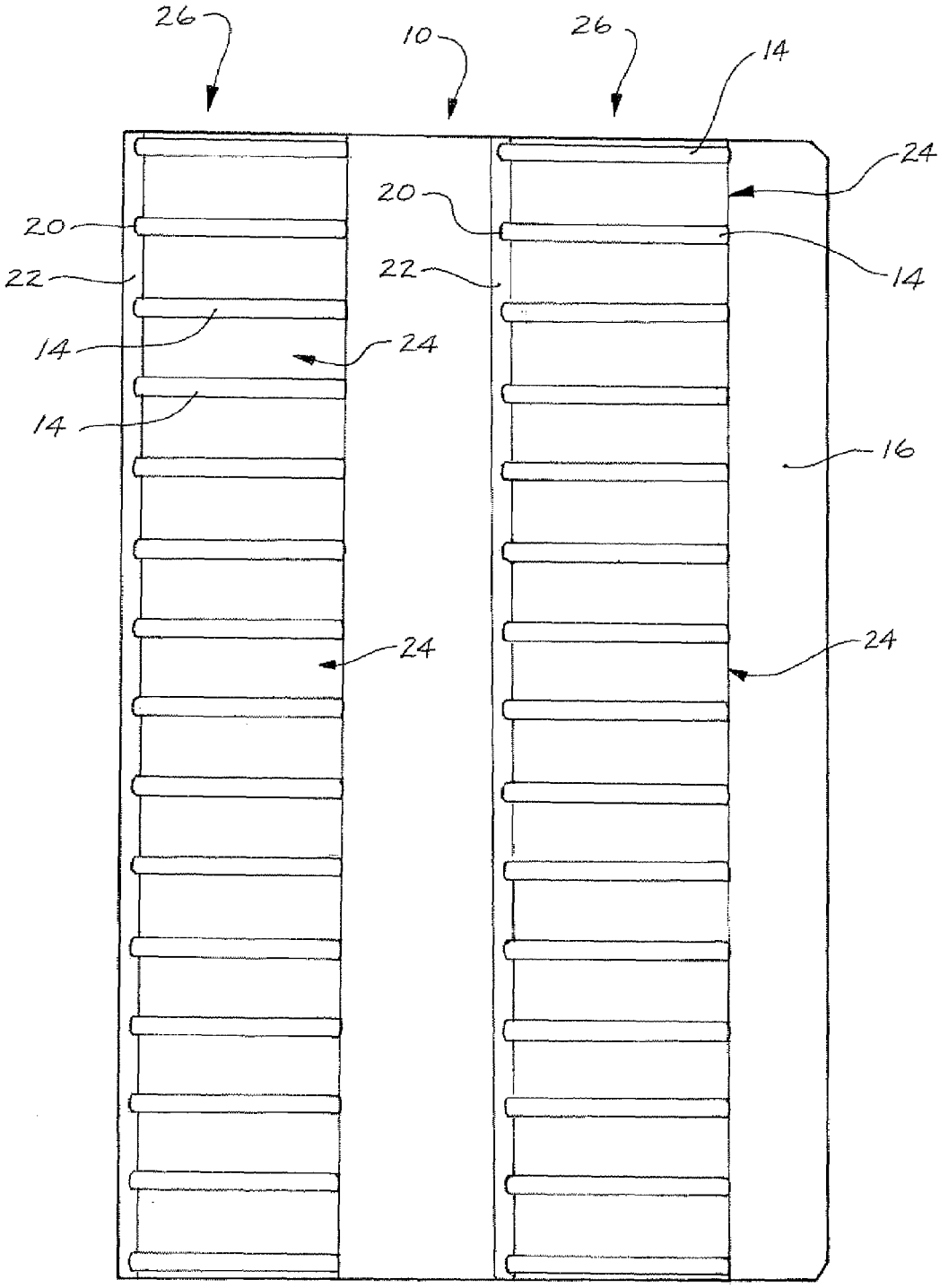
FIG. 1 is plan view of the insert according to the present invention.
Figure 2:
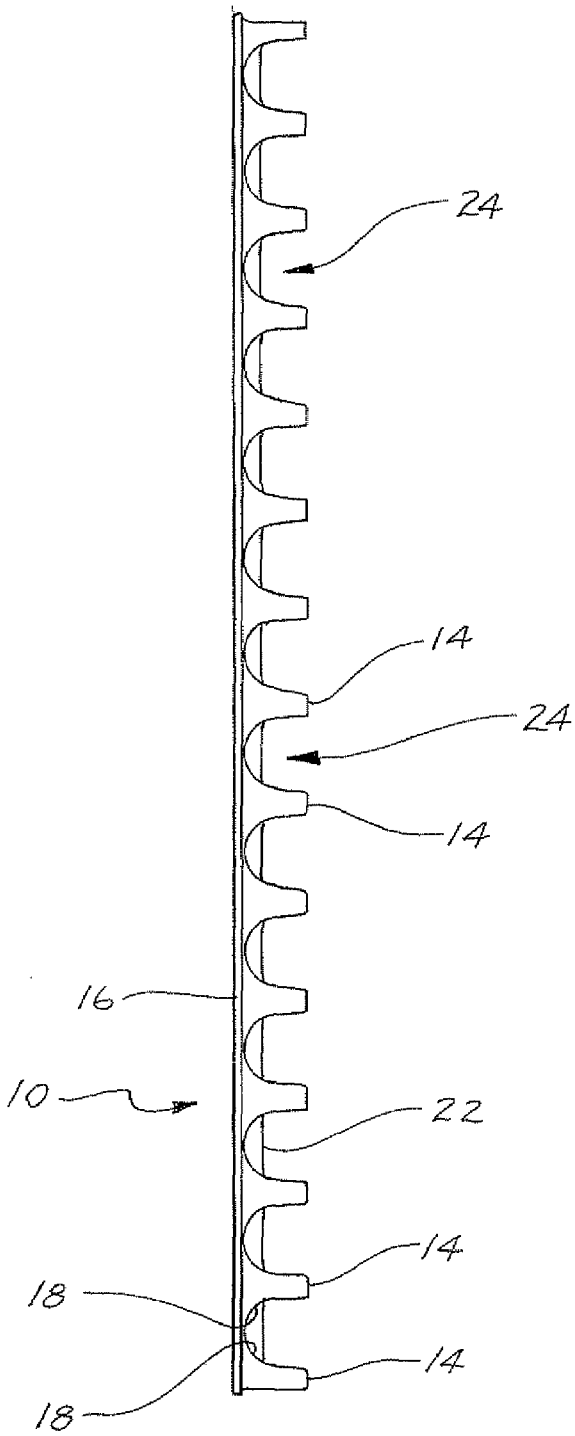
FIG. 2 is a side view of the insert according to the present invention.
Figure 3:
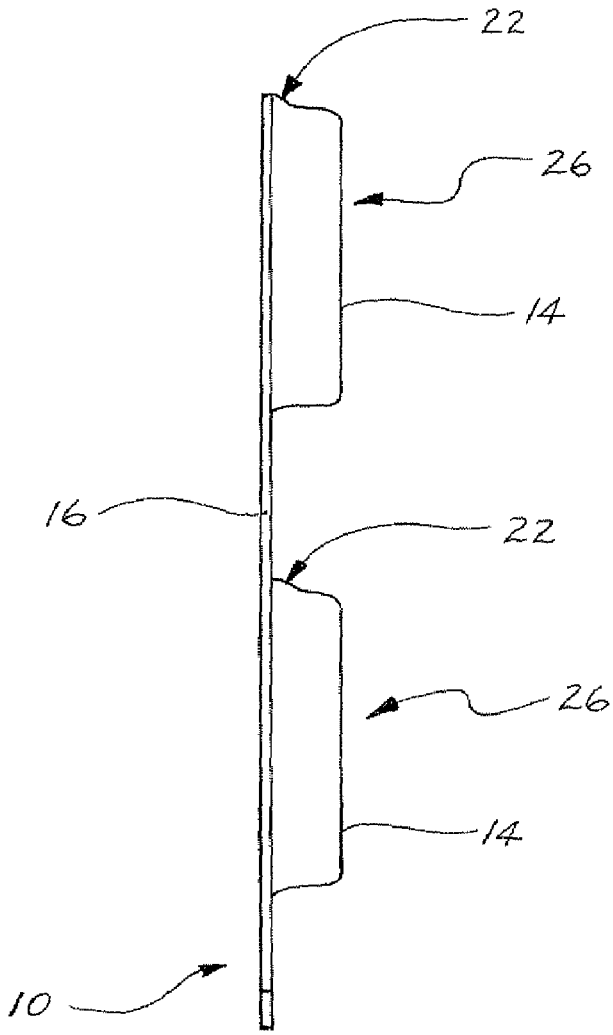
FIG. 3 is an end view of the insert illustrated in FIGS. 1 and 2.
Figure 4:
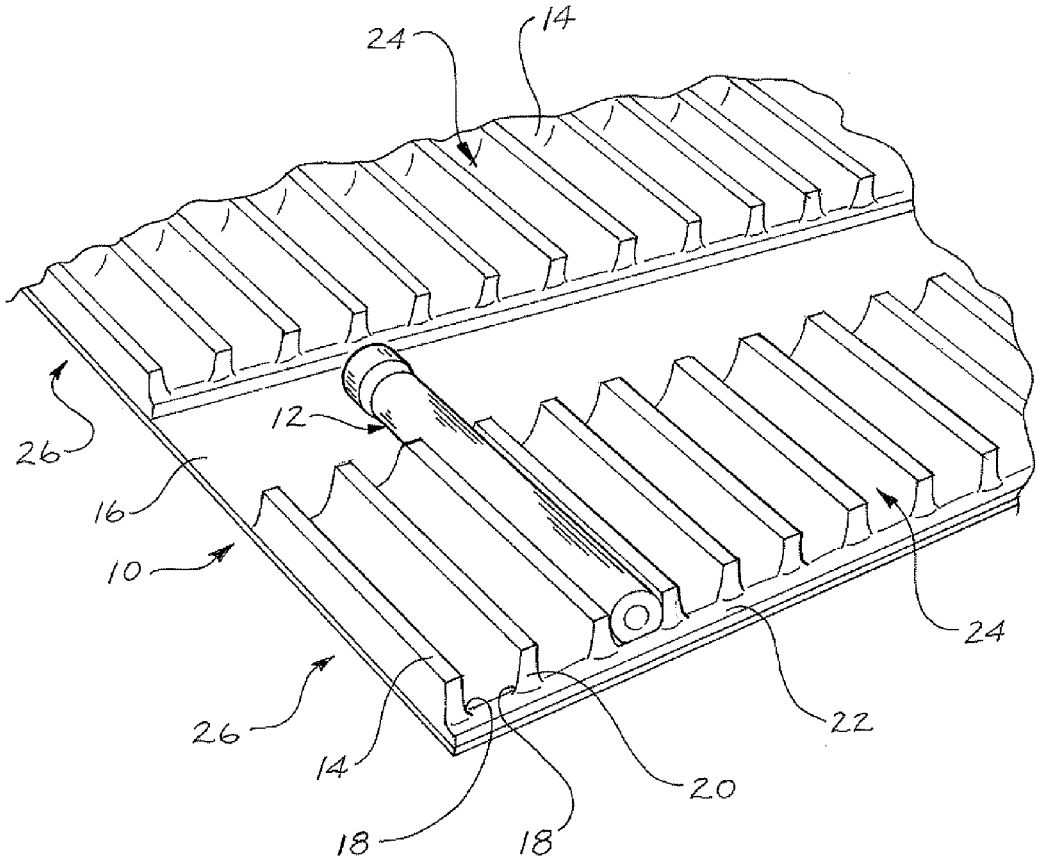
FIG. 4 is a detailed perspective view of a portion of the insert according to the present invention with a vial held between two general parallel walls or ridges for storage.
Figure 5:
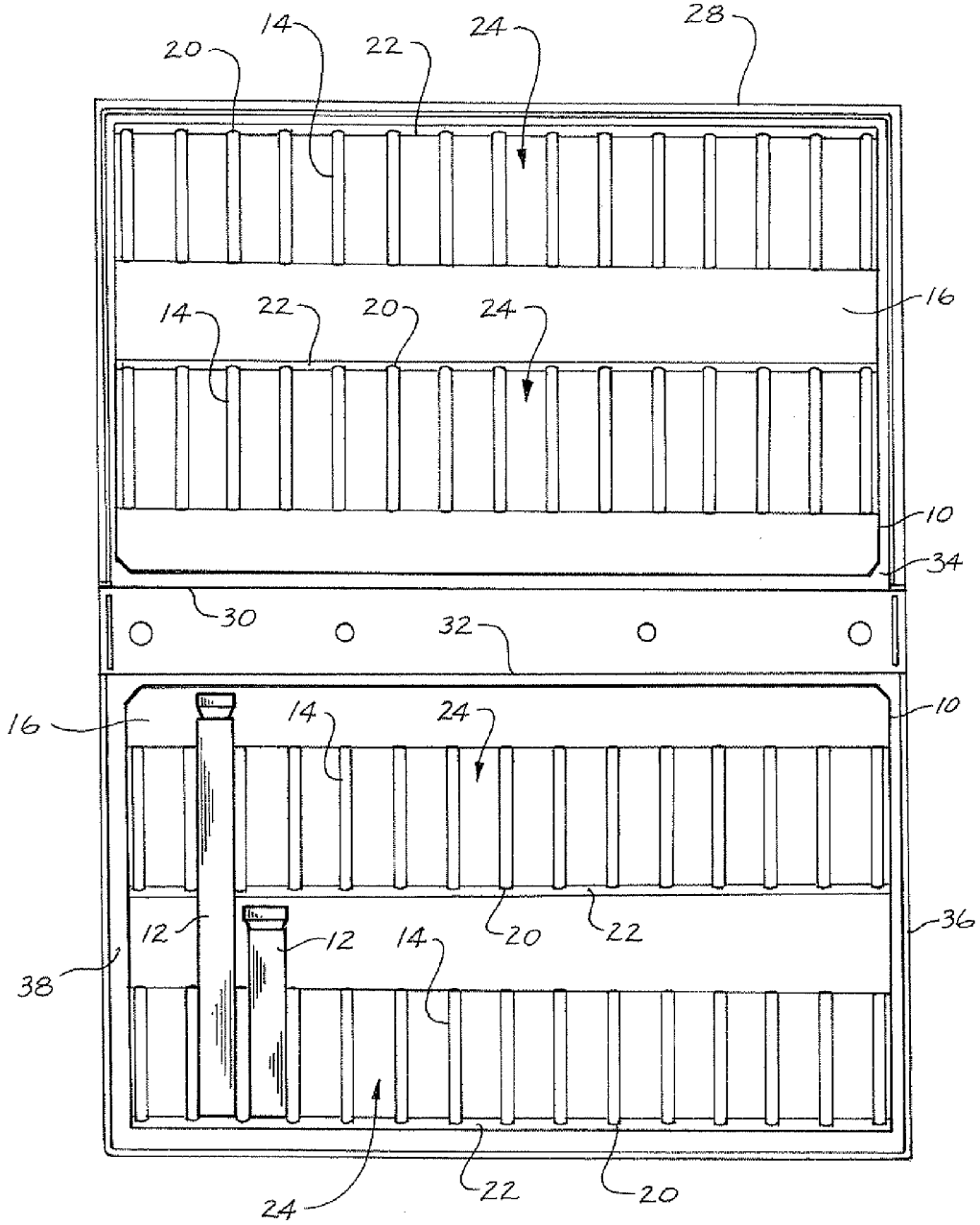
FIG. 5 is a plan view of the insert assembled within a cassette case according to the present invention.

Referring to FIGS. 1-4, an insert 10 according to the present invention retains vials, ampules, containers, receptacles, or the like, hereinafter referred to generically as simply vials 12. The insert 10 is preferably formed of a plastic material by any suitable known method of manufacturing. By way of example and not limitation, the insert 10 according to the present invention can be manufactured from a sheet of material by vacuum forming, or blow forming, or can be formed by injection molding. The insert 10 can be made to any desired dimensions for the particular application. The insert 10 can be configured to have any desired length, width and height or thickness. In each case, the insert 10 includes a plurality of parallel walls or ridges 14 spaced transversely with respect to one another at a distance slightly less than an outer diameter of the vial 12 to be received therebetween. The ridges 14 extend outwardly from the base 16 of the insert 10. In the preferred configuration of the present invention best seen in FIG. 2, the surface extending between adjacent ridges 14 can include a curved portion 18 adjacent the base 16, or curved arcuate concave surface extending between the adjacent parallel ridges 14. In the preferred configuration, each ridge 14 extends longitudinally with respect to the vial 12 to be held along a substantial longitudinal length of the vial, and more preferably along at least one half of the longitudinal length of each vial 12, and most preferably greater than one half of the length of the vial 12 to be held therebetween. As best seen in FIG. 1, adjacent one longitudinal end 20 of the ridges 14, a stop rib or protuberance 22 is provided for engaging a corresponding end of the vial 12 to be held between the parallel walls 14 of the insert 10. The transversely extending stop rib 22 further enhances rigidity of the insert 10 while providing a stop for engagement with an end of each vial 12 placed between adjacent parallel walls 14. By way of example and not limitation, the insert 10 according to the present invention as illustrated in FIGS. 1-4 includes fifteen parallel walls 14 defining fourteen vial-receiving slots 24 in each row. In the preferred configuration as illustrated in FIG. 1, the insert 10 according to the present invention includes a plurality of rows 26 of parallel walls or ridges 14. By way of example and not limitation, in the illustrated embodiment in FIGS. 1-4, two rows 26 of vial-receiving slots 24 defined by the plurality of parallel walls 14 are provided in the insert 10. It should be recognized that the total number of vial-receiving slots 24 can be modified according to the particular application, size of container desired, and number of vials to be stored per container. It should be further recognized that a long vial 12 can extend to be held by two or more pairs of aligned ridges as best seen in FIG. 5. The precise configuration of the dimensions, the number of walls, the number of slots, and the number of rows can be varied without departing from the scope of the present invention.

Figure 6:
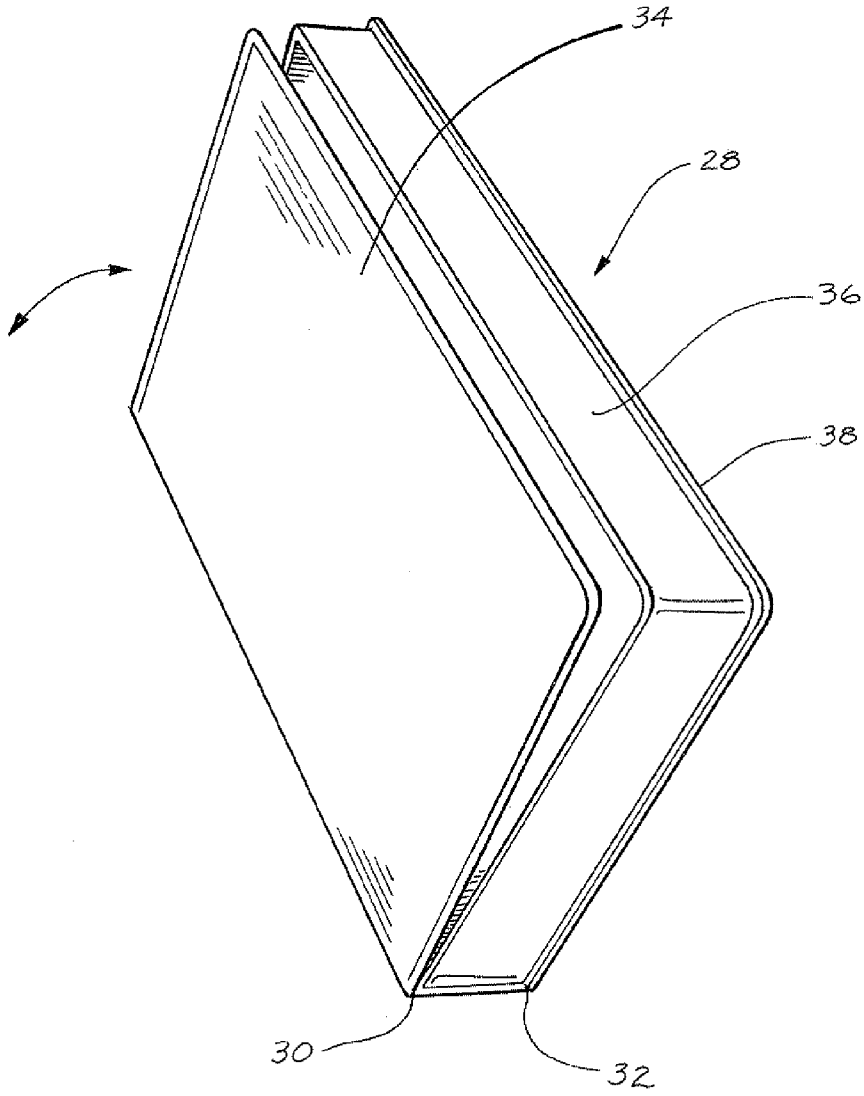
FIG. 6 is a perspective view of the case in a partially closed configuration.
Figure 7:
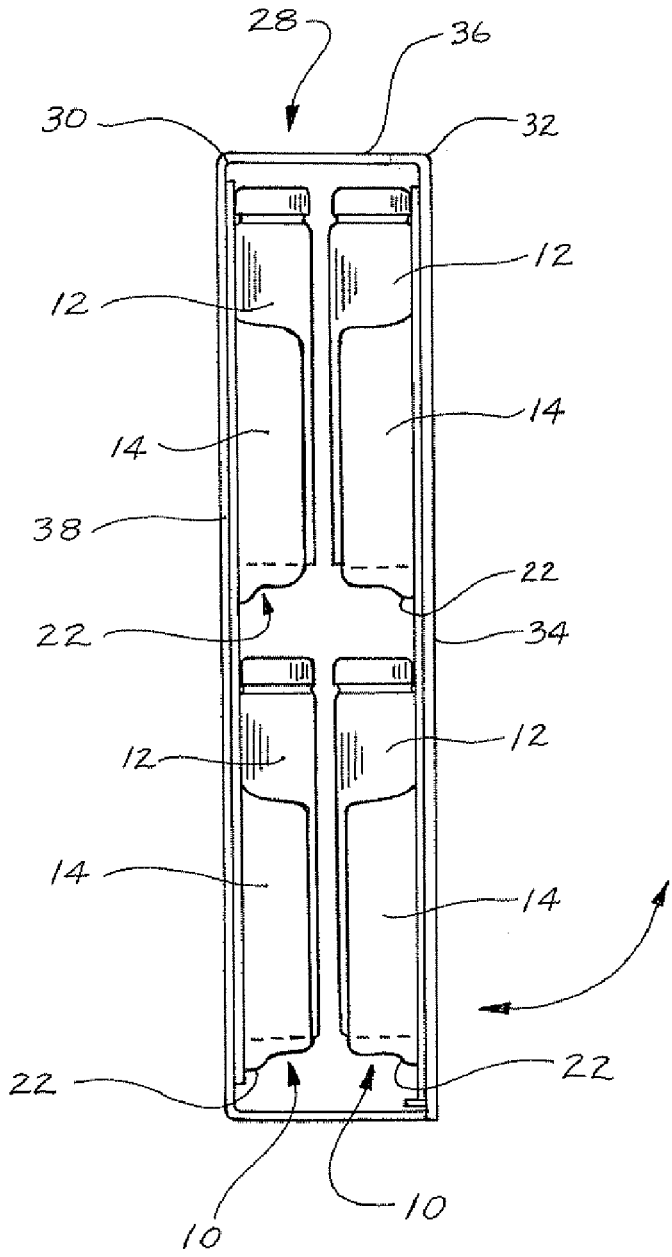
FIG. 7 is a cross-sectional view of the closed case showing a plurality of vials stored therein.

Referring now to FIGS. 5-7, the insert 10 according to the present invention can be used individually, or can be incorporated into a separate case, or can be integrally molded as part of the case structure in accordance with the present invention. By way of example and not limitation, the insert 10 according to the present invention is shown assembled within a case 28, such as a standard VHS cassette case or other case of suitable dimensions for the vials to be stored, made of plastic material with living hinges 30, 32 to create a folding cover portion 34 that can be snapped in place to hold the cover portion 34 with respect to sidewalls 36 extending outwardly from a back wall 38. Depending on the storage capacity desired, a single insert 10 can be assembled to either the back wall 38 or cover portion 34 of the case 28, or one insert 10 can be assembled to the back wall while a second insert 10 is assembled to the cover portion 34 to double the storage capacity. Depending on the configuration desired for the internal storage of the case 28, the insert 10 can be integrally formed with the case 28 or assembled with the case 28 in the configuration as shown in FIG. 5, or the inserts 10 can be assembled in the same orientation with respect to one another or in opposite orientation with respect to one another. When formed in the configuration as shown in FIG. 5, a cross-section taken through the closed container as illustrated in FIG. 7 provides four vials in the same orientation within the closed case 28. By way of example and not limitation, the insert 10 illustrated provides storage for twenty-eight vials 12 with respect to each insert 10. When two inserts are provided within the case 28, the case has a storage capacity of fifty-six vials. It should be recognized that the storage capacity can be modified depending on the size of the vials to be stored, and the size of the case to be used to enclose the vials. In the preferred configuration, each insert includes fifteen parallel walls 14 defining fourteen vial-receiving slots in each of two rows 26. The stop rib 22 is formed along one longitudinal end 20 of each of the plurality of parallel walls 14 of each row. The stop rib 22 can be formed on the same side of the two rows, or can be formed on opposite sides of the two rows, or can be formed on the two adjacent sides ends of the two rows depending on the desired orientation of the vials to be stored. It should be recognized that the two inserts 10 illustrated in FIG. 5 are shown as being identical inserts, but could be inserts of different configurations for different size vials, or could be configured having a different orientations of stop ribs 22, or different spacing of parallel walls 14 for different size vials 12 to be stored therein. It should further be recognized that while the insert has been disclosed as being formed separately from the case, that the parallel walls 14 and stop ribs 22 could be formed integrally with the wall of the case 28 if desired. In the preferred configuration, the elongate ridges 14 of each row 26 extending transversely in parallel relationship with respect to one another. A stop rib 22 extends transversely adjacent one end 20 of each row 26 of the plurality of ridges 14. Each elongate ridge 14 of the plurality of ridges having a common longitudinal axis with a corresponding ridge 14 in an adjacent row 26 of the plurality of ridges.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. In an apparatus for receiving a plurality of elongate vials, each vial having a longitudinal length and an outer maximum diameter, the improvement comprising:

a single piece insert having a planar base defined by a wall with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of vials to be located therebetween, the elongate ridges extending along a substantial portion of vials to be received therein, the plurality of elongate ridges including at least two rows of elongate ridges, each row of elongate ridges spaced longitudinally from one another and separated by a flat portion of the wall of the insert, the flat portion of the wall located coplanar with the planar base.

2. The apparatus of claim 1 further comprising:

a stop rib of constant dimension extending outwardly in the forward direction from the planar base and extending transversely adjacent one end of the plurality of ridges.

3. The apparatus of claim 2, wherein the stop rib extends a sufficient constant distance outwardly in the forward direction from the planar base for operably engaging with an end of each vial to be received within the vial-receiving slots, and the sufficient constant distance being less than an outward dimension of the plurality of ridges.

4. The apparatus of claim 1 further comprising:

a stop rib of constant dimension extending outwardly in the forward direction from the planar base and extending transversely adjacent one end of each row of the plurality of ridges.

5. The apparatus of claim 1 further comprising:

each elongate ridge of the plurality of ridges having a common longitudinal axis with a corresponding ridge in an adjacent row of the plurality of ridges.

6. The apparatus of claim 1 further comprising:

a case associated with the single piece insert, the case having a back wall, at least one peripheral side wall, and a cover.

7. The apparatus of claim 6, wherein the single piece insert further comprises:

a first single piece insert associated with the back wall of the case; and a second identical single piece insert associated with the cover of the case.

8. In a process for manufacturing an apparatus for receiving a plurality of elongate vials, each vial having a longitudinal length and an outer maximum diameter, the improvement to the process comprising the steps of:

forming a single piece insert having a planar base defined by a wall with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of vials to be located therebetween, the elongate ridges extending along a substantial portion of vials to be received therein, the plurality of elongate ridges including at least two rows of elongate ridges, each row of elongate ridges spaced longitudinally from one another and separated by a flat portion of the wall of the insert, the flat portion of the wall located coplanar with the planar base.

9. The process of claim 8, wherein the forming step further comprises:

forming a stop rib of constant dimension extending outwardly in the forward direction from the planar base and extending transversely adjacent one end of the plurality of ridges.

10. The process of claim 8, wherein the forming step further comprises:

forming the stop rib extending a sufficient constant distance outwardly in the forward direction from the planar base for operably engaging with an end of each vial to be received within the vial-receiving slots, and the sufficient constant distance being less than an outward dimension of the plurality of ridges.

11. The process of claim 10, wherein the forming step further comprises:

forming each elongate ridge of the plurality of ridges having a common longitudinal axis with a corresponding ridge in an adjacent row of the plurality of ridges.

12. The process of claim 8, wherein the forming step further comprises:

forming a stop rib of constant dimension extending outwardly in the forward direction from the planar base and extending transversely adjacent one end of each row of the plurality of ridges.

13. The process of claim 8 further comprising the step of:

associating a case with the single piece insert, the case having a back wall, at least one peripheral side wall, and a cover.

14. The process of claim 13, wherein the associating step further comprises the steps of:

associating a first single piece insert with the back wall of the case; and associating a second identical single piece insert with the cover of the case.

15. In an apparatus manufactured according to the process of claim 8 for receiving a plurality of elongate vials, each vial having a longitudinal length and an outer maximum diameter, the improvement of the apparatus comprising:

a single piece insert having a planar base defined by a wall with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of vials to be located therebetween, the elongate ridges extending along a substantial portion of vials to be received therein, the plurality of elongate ridges including at least two rows of elongate ridges, each row of elongate ridges spaced longitudinally from one another and separated by a flat portion of the wall of the insert, the flat portion of the wall located coplanar with the planar base.

16. An apparatus for receiving a plurality of elongate vials, each vial having a longitudinal length and an outer maximum diameter, the apparatus comprising:

a case having a rectangular back wall, at least one peripheral side wall, and a rectangular cover;

a plurality of elongate vials, each vial having a longitudinal length and an outer maximum diameter; and at least one insert associated with the case, each insert having a planar, rectangular shaped base with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of a vial to be held therebetween, the elongate ridges extending along a substantial portion of the longitudinal length of each vial to be received therein, and an elongate stop rib extending outwardly in the forward direction a sufficient constant distance from the planar base for operably engaging with an end of each vial to be received within the vial-receiving slots, and the sufficient constant distance being less than an outward dimension of the plurality of ridges.

17. The apparatus of claim 16 further comprising:

each elongate ridge of the plurality of ridges having a common longitudinal axis with a corresponding ridge in an adjacent row of the plurality of ridges.

18. The apparatus of claim 16, wherein the at least one of the inserts further comprises:

a first insert associated with the back wall of the case; and a second insert associated with the cover of the case.

19. An apparatus for receiving a plurality of elongate vials, each vial having a longitudinal length and an outer maximum diameter, the apparatus comprising:

a case having a rectangular back wall, at least one peripheral side wall, and a rectangular cover;

a plurality of elongate vials, each vial having a longitudinal length and an outer maximum diameter; and at least one single piece insert associated with the case, each single piece insert having a planar, rectangular base defined by a wall with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance slightly less than the outer maximum diameter of each vial to be received therein permitting an interference fit therebetween, the elongate ridges extending along a substantial portion of the longitudinal length of each vial to be received therein, the plurality of elongate ridges including at least two rows of elongate ridges, each row of elongate ridges spaced longitudinally from one another and separated from one another with a flat portion of the wall, the flat portion of the wall located coplanar with the planar base.

20. The apparatus of claim 19 further comprising:

an elongate stop rib of constant outward dimension in the forward direction from the planar base and extending transversely adjacent one end of each row of the plurality of ridges.

21. An apparatus for receiving a plurality of elongate vials, each vial having a longitudinal length and an outer maximum diameter, the apparatus comprising:

a case having a rectangular back wall, at least one peripheral side wall, and a rectangular cover;

a plurality of elongate vials, each vial having a longitudinal length and an outer maximum diameter; and at least one single piece insert associated with the case, each single piece insert having a planar, rectangular base defined by a wall with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance slightly less than the outer maximum diameter of each vial to be received therein permitting an interference fit therebetween, the elongate ridges extending along a substantial portion of the longitudinal length of each vial to be received therein, and an elongate stop rib extending outwardly in the forward direction a sufficient constant distance from the planar base for operably engaging with an end of each vial to be received within the vial-receiving slots, and the sufficient constant distance being less than an outward dimension of the plurality of ridges.

22. In an apparatus for receiving a plurality of elongate vials, each vial having a longitudinal length and an outer maximum diameter, the improvement comprising:

a case having a rectangular back wall, at least one peripheral side wall, and a rectangular cover; and at least one insert associated with the case, each insert having a planar, rectangular shaped base with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of vials to be located therebetween, the elongate ridges extending along a substantial portion of vials to be received therein, and an elongate stop rib extending outwardly in the forward direction a sufficient constant distance from the planar base for operably engaging with an end of each vial to be received within the vial-receiving slots, and the sufficient constant distance being less than an outward dimension of the plurality of ridges.

23. The apparatus of claim 22 further comprising:

each elongate ridge of the plurality of ridges having a common longitudinal axis with a corresponding ridge in an adjacent row of the plurality of ridges.

24. The apparatus of claim 22, wherein the at least one of the inserts further comprises:

a first insert associated with the back wall of the case; and a second insert associated with the cover of the case.

25. In an apparatus for receiving a plurality of elongate vials, each vial having a longitudinal length and an outer maximum diameter, the improvement comprising:

a case having a rectangular back wall, at least one peripheral side wall, and a rectangular cover; and at least one single piece insert associated with the case, each of the at least one single piece insert having a planar, rectangular base defined by a wall with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of vials to be located therebetween, the elongate ridges extending along a substantial portion of vials to be received therein, the plurality of elongate ridges including at least two rows of elongate ridges, each row of elongate ridges spaced longitudinally from one another and separated from one another with a flat portion of the wall, the flat portion of the wall located coplanar with the planar base.

26. The apparatus of claim 25 further comprising:

an elongate stop rib of constant outward dimension in the forward direction from the planar base and extending transversely adjacent one end of each row of the plurality of ridges.

27. In an apparatus for receiving a plurality of elongate vials, each vial having a longitudinal length and an outer maximum diameter, the improvement comprising:

a case having a rectangular back wall, at least one peripheral side wall, and a rectangular cover; and at least one single piece insert associated with the case, each of the at least one single piece insert having a planar, rectangular base defined by a wall with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of vials to be located therebetween, the elongate ridges extending along a substantial portion of vials to be received therein, and an elongate stop rib extending outwardly in the forward direction a sufficient constant distance from the planar base for operably engaging with an end of each vial to be received within the vial-receiving slots, and the sufficient constant distance being less than an outward dimension of the plurality of ridges.

28. In an apparatus for receiving a plurality of elongate vials, each vial having a longitudinal length and an outer maximum diameter, the improvement comprising:

at least one single piece insert associated with a case, each insert having a planar, rectangular shaped base with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of vials to be located therebetween, the elongate ridges extending along a substantial portion of vials to be received therein; and an elongate stop rib extending outwardly in the forward direction a sufficient constant distance from the planar base for operably engaging with an end of each vial to be received within the vial-receiving slots, and the sufficient constant distance being less than an outward dimension of the plurality of ridges.

29. The improvement of claim 28 further comprising:

said case having a rectangular back wall, at least one peripheral side wall, and a rectangular cover.

30. In an apparatus for receiving a plurality of elongate vials, each vial having a longitudinal length and an outer maximum diameter, the improvement comprising:

at least one insert having a planar base with a front surface and a back surface, a plurality of integrally formed, parallel, elongate ridges extending outwardly in a forward direction with respect to the front surface of the planar base and extending in transversely spaced relationship with respect to one another to define a vial-receiving slot in the front surface between each pair of adjacent ridges, each of the plurality of vial-receiving slots located forward of the planar base and located between each pair of adjacent ridges, the elongate ridges spaced transversely from one another by a distance permitting an interference fit of vials to be located therebetween, the elongate ridges extending along a substantial portion of vials to be received therein; and an elongate stop rib extending outwardly in the forward direction a sufficient distance from the planar base for operably engaging with an end of each vial to be received within the vial-receiving slots, and the sufficient distance being less than an outward dimension of the plurality of ridges.

31. The improvement of claim 30 further comprising:

the at least one insert defining a plurality of elongate ridges including at least two rows of elongate ridges, each row of elongate ridges spaced longitudinally from one another and separated by a flat surface.

* * * * *